US006102818A

United States Patent [19]

Hamilton

[11] Patent Number: 6,102,818

[45] Date of Patent: Aug. 15, 2000

[54] STANCE AND STRIDE TRAINING DEVICE

[76] Inventor: Dwaine S. Hamilton, 263 Ridge Crest Dr., West Carrollton, Ohio 45449

[21] Appl. No.: 08/986,446

[22] Filed: Dec. 8, 1997

[51] Int. Cl.[7] ..... A63B 71/02; A63B 69/00

[52] U.S. Cl. ..... 473/452

[58] Field of Search ..... 434/247; 473/218, 473/422, 452, FOR 103

[56] References Cited

U.S. PATENT DOCUMENTS

| | | | |
|---|---|---|---|
| 3,236,520 | 2/1966 | Friedman | 473/452 |
| 3,979,116 | 9/1976 | Matchick | 473/452 |
| 4,164,352 | 8/1979 | O'Brien | 473/218 |
| 4,355,810 | 10/1982 | Rydeck | 473/218 |
| 4,932,656 | 6/1990 | Pierce | 473/452 |
| 5,330,176 | 7/1994 | Cagney | 473/452 |
| 5,536,004 | 7/1996 | Wiseman | 473/417 |
| 5,603,617 | 2/1997 | Light | 434/252 |

FOREIGN PATENT DOCUMENTS

| | | |
|---|---|---|
| 1305710 | 2/1973 | United Kingdom . |
| 01202 | 4/1983 | WIPO . |

*Primary Examiner*—John A. Ricci
*Attorney, Agent, or Firm*—Ralph L. Marzocco

[57] ABSTRACT

An athletic training device for teaching proper technique for hitting, throwing, and fielding a baseball has positional indicia affixed to both sides of a stance and stride mat. One side has positional indicia for teaching proper technique for hitting a baseball and in practice is used in conjunction with a batting Tee having directly opposed positional indicia. In a game, when stance and stride batting mat is removed from the batter's box, a batter can guide on the positional indicia affixed to the batting Tee. The other side has positional indicia for teaching proper technique for throwing and fielding a baseball and in practice can be used at any convenient location on the playing field.

1 Claim, 1 Drawing Sheet

STANCE AND STRIDE TRAINING DEVICE

BACKGROUND OF THE INVENTION

1. Field of the Invention

The present invention generally relates to an athletic training device. More particularly, the invention relates to a stance and stride training device for instructing individuals, especially novices, in the art of positioning of one's feet when engaged in athletic activities of hitting and throwing a baseball.

2. Description of the Prior Art

Numerous training devices are available for use as aids in teaching individuals engaged in athletic activities the proper technique for hitting a baseball, the proper technique for striking a golf ball, or the proper teachnique for swinging at a tennis ball. Essentially, proper technique for hitting a ball involves the variables of timing of the swing and movement, if any, of the ball. However, many of the prior art training devices, being cumbersome and complicated, require substantial adult participation for assembly before use by younger individuals.

Representative of the prior art disclosing a device for use as an aid in teaching proper technique for throwing a baseball in U.S. Pat. No. 3,236,520 (Friedman). However, the device, which is described as being a portable pitcher's mound that may be placed upon a flat floor so that the user thereof will have the same angular relationship and conditions as are present on a regulation playing field, is pitcher limited, whose throwing technique or delivery is unique unlike the throwing technique of other team players.

Representative of the prior art disclosing a device for use as an aid in teaching proper technique for hitting a baseball are U.S. Pat. Nos. 5,330,176 (Cagney), and U.S. Pat. No. 5,536,004 (Wiseman et al.). However, the devices, which are described as a planar surface with indicia designating position of feet for proper batting stance, are mainly concerned with the orientation of the batter in relation to home plate, the pitcher, and to the ball. Although the Cagney patent: describes stride designating indicia, the device merely indicates stride direction, but not the amount of stride distance the leading foot of the batter moves. Furthermore, prior art stance and stride training devices are for teaching proper batting not throwing techniques.

Also representative of the prior art disclosing a device for use as an aid in teaching proper technique for hitting a baseball are U.S. Pat. No. 3,342,487 (David), U.S. Pat. No. 3,979,116 (Matchick), and U.S. Pat. No. 4,932,6156 (Pierce), and a device for hitting a golf ball are Brit. Pat. No. 1,305,710, PCT WO 83/01202, and U.S. Pat. No. 5,603,617.

While many of the structural arrangements of devices of the prior art for use as an aid in teaching proper techniques for hitting a ball appear to function reasonably well and generally achieve the objectives for which they were designed, most seem to embody shortcomings which make them less than an exemplary design. Consequently, a need still exists for a different approach to design a stance and stride training device for youngsters learning proper batting and throwing techniques.

SUMMARY OF THE INVENTION

The present invention provides a stance and stride training device that satisfies the aforementioned need for improvement in known baseball training devices so as to overcome the above-described shortcomings without introducing new ones in their place.

In accordance with the teachings of the present invention, youngsters learning the art of hitting and throwing a baseball are greatly benefitted with the instructive aid gained by using the stance and stride training device of this invention. The device comprises a rectangular-shaped mat for placement near home plate of a baseball playing field placed with a leading edge of one width of the mat located nearer to the outfield and with a trailing edge of the other width of the mat located farther to the outfield. A series of three parallel stripes are affixed onto the obverse side of the mat with each stripe at a predetermined distance from another stripe and each stripe parallel to the front edge of the mat. The front or first stripe of the series depicts a first color and the middle stripe and back stripe of the series depict a second color. Located directly opposite to the first stripe and middle stripe affixed to the mat are a first stripe and a second stripe that are affixed to home plate.

A series of three parallel stripes are affixed onto the reverse side of the mat with each stripe of a predetermined distance from another stripe and each stripe perpendicular to the front edge of the mat. The middle stripe is located nearer to the front edge of the mat while the two outside stripes are located somewhat further from the front edge of the mat. The two outside stripes depict a second color and the middle stripe depicts a first color. While the obverse or batting side of the mat which generally is placed near home plate, the reverse or throwing side of the mat generally is placed along the side lines of the baseball field.

The features and attainments of the present invention will become apparent to those skilled in the art upon a reading of the detailed description when taken in conjunction with the drawings wherein there is shown and described an illustrative embodiment of the invention.

BRIEF DESCRIPTION OF THE DRAWINGS

For a further understanding of the nature and object of the invention, reference should be had to the detailed description of the exemplary embodiment when taken in conjunction with the appended drawings in which.

DETAILED DESCRIPTION OF THE INVENTION

Figure 1:
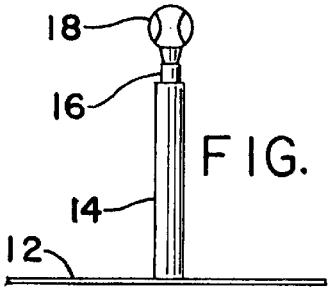
FIG. 1 is a side elevational view of a batting Tee that is conjunctionally used with the stride and stance training device of the present invention.

In the following description, like reference characters designate like on corresponding parts throughout the several view of the drawings. The drawings show elements of the present invention which are merely representative of the preferred embodiment inasmuch as the preferred embodiment employs colored elements which are not possible to show in the drawings. Also in the following description, it is to be understood that such terms as "forward", "rearward", "left", "right", "upwardly", "downwardly", and the like, are words of convenience and are not to be construed as limiting terms.

Figure 3:
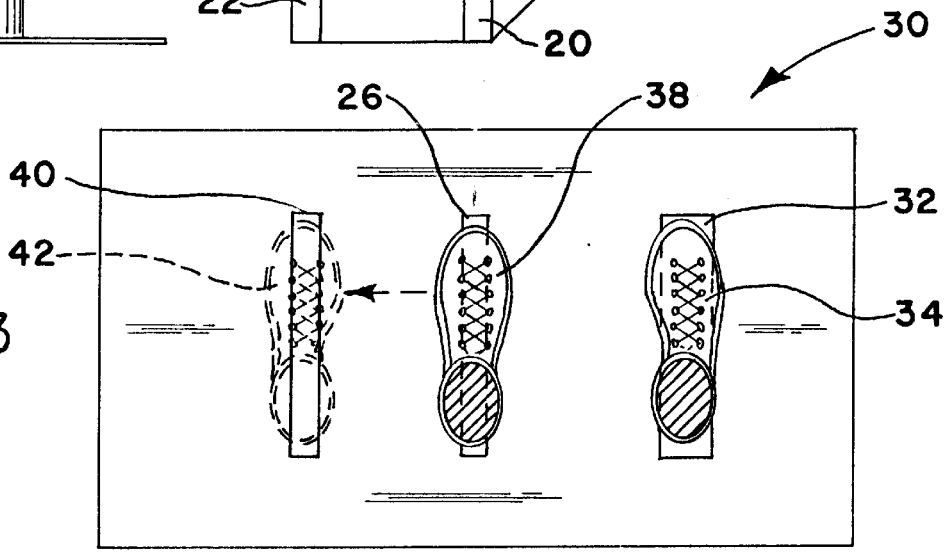
FIG. 3 is a top view of a batting mat of the stance and stride training device of the present invention with a right foot shoe and a left foot shoe of a batter in the stance position and a phantom left foot shoe of a batter in the stride position.
Figure 4:
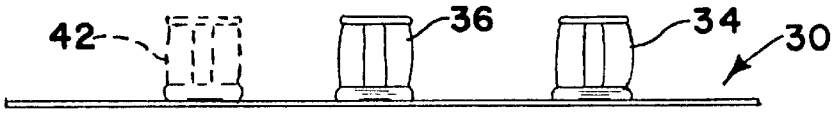
FIG. 4 is a side elevational view of the stance and stride training device of the present invention with a right foot shoe and a left foot shoe of a batter in the stance position and a phantom left foot shoe of a batter in the stride position.

Referring now to the drawings of the stance and stride training device of the present invention, and particularly to FIGS. 3 and 4, there is illustrated a stance and stride batting mat generally designated by the numeral 30 and constituting one aspect of the preferred embodiment. Stance and stride batting mat 30 is a planar, rectangular-shaped sheet consisting of a group of pliable materials such as polymerics, fabrics, and others known to those skilled in the art which may be rolled into a compact package for ease of transport and storage. Alternatively, stance and stride batting mat 30 consists of a group of rigid materials such as plastics, woods, laminates, and others known to those skilled in the art. Whether a pliable or a rigid material is selected, generally, the thickness of stance and stride batting mat 30 is that amount needed to withstand users standing and striding on batting mat 30 without movement therefrom coupled with the need to withstand considerable wear and tear.

Generally, when a novice is taking batting practice, stance and stride batting mat 30 is placed near home plate 12 of a baseball playing field in the area commonly known as the batter's box. And stance and stride batting mat 30 may be placed to the right of home plate 12 to accomodate left-hand batters or to the left of home plate 12 to accomodate right-hand batters.

Stance and stride batting mat 30 is placed with respect to home plate 12 and to the pitcher's mound of a baseball playing field (not shown) so that its first width (a dimensionally lesser first side of rectangular-shaped stance and stride batting mat 30) and leading edge is located nearer to the pitcher's mound (not shown) while its second width (a dimensionally lesser second side of rectangular-shaped stance and stride batting mat 30) and trailing edge is located further to the pitcher's mound (not shown).

Positional indicia are affixed to stance and stride batting mat 30 comprising a series of three parallel stripes 26, 32, and 40 with each stripe at a predetermined distance from another stripe and each stripe parallel to the first side and leading edge of stance and stride batting mat 30. The length of stripes 26, 32, and 40 are equal, however the width of stripe 32 is somewhat greater than stripes 26 and 40. This somewhat greater width of stripe 32 allows for variations of leg spreads of novices.

Stripes 26, 32, and 40 may be affixed to stance and stride mat 30 by a painting process, a silk screening process, or any other commonly used coating process known to those skilled in the art.

Stance stripes 26 and 32 are preferably affixed to stance and stride batting mat 30 as a red color, while stride stripe 40 is preferably affixed to stance and stride batting mat 30 as a green color. As is shown in FIGS. 3 and 4, a right-handed novice places shoe 34 of his right back foot on red stripe 32 and places shoe 38 of his left front foot on red stripe 26. As the novice batter starts to swing his bat at a baseball 18 sitting atop a batting Tee 10, he starts to move his front foot of his left leg to green stripe 40. And as is shown in phantom in FIGS. 3 and 4, at the completion of his swing his left foot shoe 42 of his left leg rests on green stripe 40. Essentially, proper technique for a batter hitting a baseball placed atop a batting Tee involves timing of bat swing and front foot movement in relationship with position of feet of batter.

Figure 2:
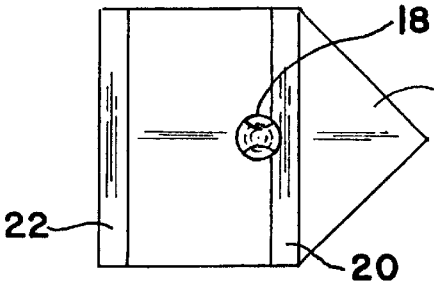
FIG. 2 is a top view of a batting Tee with two colored stripes affixed to home plate that is conjunctionally used with the stride and stance training device of the present invention.

As was mentioned hereinabove, stance and stride batting mat 30 is placed near home plate 12 of a baseball playing field in the area commonly known as the batter's box. As is shown in the side elevational view of FIG. 1 of a batting Tee 10 and especially the top view of batting Tee 10 of FIG. 2, stance and stride batting mat 30 may be used conjunctionally with batting Tee 10. Such batting Tee 10 comprises a base defining a home plate 12 that has attached thereto a centrally located, vertically standing cylinder 14 with a telescoping inner cylinder 16 atop whose topmost portion a baseball 18 is placed.

A pair of stripes 20 and 22 are coated atop home plate 12 with stripe 20 preferably coated red and stripe 22 preferably coated green. Stripe 20 is the same color and same width as stripe 26 of stance and stride batting mat 30, while stripe 22 of home plate 12 is the same color and same width of stripe 40 of stance and stride batting mat 30. Further, stripes 20 and 26 of home plate 12 are located the same predetermined distance from one another as are stripes 26, 32, and 40 of stance and stride batting mat 30 are from one another. Thusly, whenever stance and stride batting mat 30 is placed in the batter's box near home plate 12, stripe 26 is directly opposite stripe 20 and stripe 40 is directly opposite stripe 22 of batting Tee 10.

Figure 5:
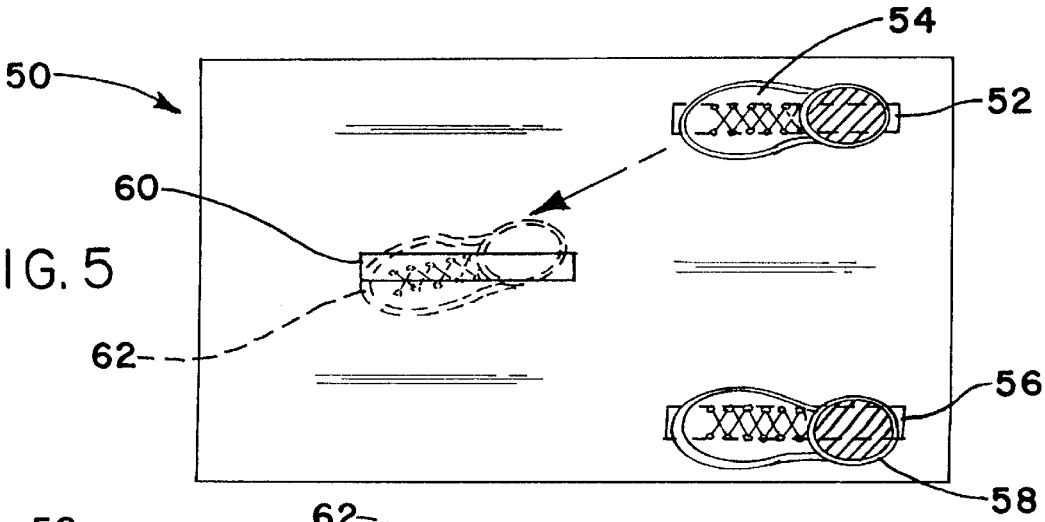
FIG. 5 is a top view of a throwing mat of the stance and stride training device of the present invention with a right foot shoe and a left foot shoe of a thrower in the stance position and a phantom right foot shoe in the stride position.
Figure 6:
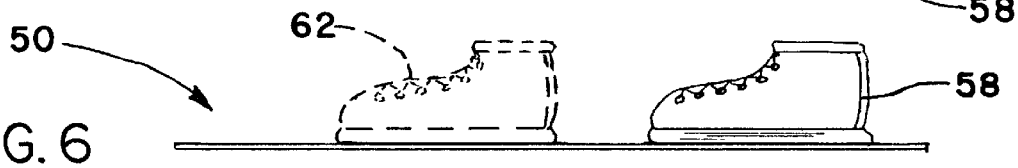
FIG. 6 is a side elevational view of the stance and stride training device of the present invention with a left foot shoe of a thrower in the stance position and a phantom right foot shoe in the stride position.

Referring once again to the drawings of the stance and stride training device of the present invention, and particularly to FIGS. 5 and 6, there is illustrated a stance and stride throwing mat generally designated by the numeral 50 and constituting another aspect of the preferred embodiment. Although stance and stride throwing mat 50 preferably comprises the reverse side of stance and stride batting mat 30, it is patently obvious that stance and stride throwing mat 50 may be a separate stance and stride training device.

Generally, when a novice is taking throwing practice, stance and. stride throwing mat 50 is placed along the right or left foul lines of a baseball field. And stance and stride throwing mat 50 is placed with respect to a thrower and to a fielder (not shown) so that its first width (a dimensionally lesser first side of rectangular-shaped. stance and stride throwing mat 50) and leading edge is located to the fielder (not shown) while its second width (a dimensionally lesser second side of rectangular-shaped stance and stride throwing mat 50) and trailing edge is located further to the fielder (not shown).

Positional indicia are similarly affixed to stance and stride throwing mat 50 comprising a series of three parallel stripes 52, 56, and 60 with each stripe at a predetermined distance from another stripe and each stripe perpendicular to the leading edge of stance and stripe throwing mat 50. The middle stripe 60 is located nearer to the leading edge of stance and stride throwing mat 50 while the two outside stripes 52 and 56 are located somewhat further from the leading edge of stance and stride throwing mat 50. Preferably, stance stripes 52 and 56 are affixed to stance and stride throwing mat 50 as a red color, while stripe 60 is affixed to stance and stride throwing mat 50 as a green color.

As is shown in FIGS. 5 and 6, a novice thrower places right foot shoe 54 of his right leg on red stripe 52 and places left foot shoe 58 of his left leg on red stripe 56. As a novice left-handed thrower starts to throw a baseball from the stance position, he starts to move right foot shoe 54 of his right leg to green stripe 60. And as is shown in phantom in FIGS. 5 and 6, at the completion of his throw right foot shoe 62 of his right leg rests on green stripe 60. Although FIG. 5 shows the stance and stride positions for a left-handed thrower, plainly, stance and stride throwing mat 50 can also be used by a right-handed thrower. In such a case a novice right-handed thrower would move left foot shoe 58 of his left leg to stride stripe 60 of stance and stride throwing mat 50.

Yet another aspect of the preferred embodiment is the use of stance and stride throwing mat 50 to teach a novice fielder the art of fielding baseballs. By placing right foot shoe 54 of his right leg on stripe 52 and left foot shoe 58 of his left leg on stripe 56, the novice learns that the art of fielding a baseball begins with his feet spread apart and not close together.

Although the preferred embodiment of the device has been described, it will be understood that within the purview of this invention various changes may be made in the form, detail, proportion, and arrangement of elements, combination thereof and method of useage, which generally stated consist in a device capable of carrying out the objects set forth, as disclosed and defined in the appended claims.

The invention having been described, what I claim is:

1. An athletic training device for teaching proper technique for hitting, throwing, and fielding a baseball comprising:

a rectangular-shaped mat with a first side for placement near home plate of a baseball playing field;

a dimensionally lesser front edge of the mat located nearer to a pitcher's mound of the baseball playing field;

a dimensionally lesser back edge of the mat located further from the pitcher's mound of the baseball playing field;

a series of three parallel stripes affixed onto the first side of the mat with each stripe at a predetermined distance from another stripe and each stripe parallel to the front edge of the mat whereby a front stripe of the series depict a first color and a middle stripe and a back stripe of the series depict a second color; and a series of three parallel stripes affixed onto a second side of the mat with each stripe at a predetermined distance from another stripe and each stripe perpendicular to the front edge of the mat with a middle stripe located nearer to the front edge of the mat and a pair of outside stripes located further from the front edge of the mat whereby the pair of outside stripes depict a second color and the middle stripe depicts a first color.

* * * * *